US006349186B1

(12) United States Patent
Park et al.

(10) Patent No.: US 6,349,186 B1
(45) Date of Patent: Feb. 19, 2002

(54) METHOD FOR CONTROLLING THE MODE OF A DEVELOPING STATION OF A LIQUID ELECTROPHOTOGRAPHIC PRINTER AND AS DEVELOPMENT ROLLER DRIVING APPARATUS THEREFOR

(75) Inventors: Woo-yong Park; Kwang-ho No, both of Suwon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/659,458

(22) Filed: Sep. 11, 2000

(30) Foreign Application Priority Data

Dec. 8, 1999 (KR) ..... 99-55960

(51) Int. Cl.[7] ..... G03G 15/08
(52) U.S. Cl. ..... 399/53; 399/237; 399/348
(58) Field of Search ..... 399/53, 237, 239, 399/249, 348, 12, 167

(56) References Cited

U.S. PATENT DOCUMENTS 6,151,470 A * 11/2000 Park ..... 399/249
6,169,860 B1 * 1/2001 Curry et al. ..... 399/12
6,215,972 B1 * 4/2001 An et al. ..... 399/249
6,215,973 B1 * 4/2001 Shin ..... 399/249

* cited by examiner

*Primary Examiner*—Arthur T. Grimley
*Assistant Examiner*—Hoan Tran
(74) *Attorney, Agent, or Firm*—Sughrue Mion, PLLC

(57) ABSTRACT

There are provided a method for controlling the mode of a developing station of a liquid electrophotographic printer and a development roller driving apparatus therefor. In the controlling method, a printing mode, a drip line removal mode and a home mode are sequentially performed, and a development roller is subjected to racing in the home mode to be cleaned. Since the development roller is cleaned in the home mode in which the development roller is spaced apart from a photosensitive belt, the photosensitive belt is not contaminated by the development roller while cleaning the development roller. Also, the cleaning of the development roller is performed after completing a drip line removal mode, so sufficient cleaning time can be obtained. The development roller driving apparatus for implementing the controlling method includes a motor which is a driving power source, a reduction gear train for reducing and transmitting power of the motor, a power relay gear engaged with the reduction gear train, and a link/gear assembly for transmitting the power relayed by the power relay gear to the development roller gear. Accordingly, the development roller can be rotated in any position corresponding to the printing mode, the drip line removal mode or the home mode. Therefore, the cleaning of a development roller is allowed in the home mode.

6 Claims, 8 Drawing Sheets

METHOD FOR CONTROLLING THE MODE OF A DEVELOPING STATION OF A LIQUID ELECTROPHOTOGRAPHIC PRINTER AND AS DEVELOPMENT ROLLER DRIVING APPARATUS THEREFOR

BACKGROUND OF THE INVENTION

1. Field of the Invention

The present invention relates to a development apparatus of a liquid electrophotographic printer, and also, to a method for controlling the mode of a developing station of a liquid electrophotographic printer, for preventing a photosensitive belt from being contaminated while cleaning the development roller and performing sufficient cleaning of the development roller and a development roller driving apparatus therefor.

2. Description of the Related Art

In general, a liquid electrophotographic printer such as a color laser printer, as shown in FIG. 1, includes a photosensitive belt 10 supported by a plurality of rollers 11, 12 and 13 installed in a printer body (not shown) which makes a circular movement in an endless track. An image to be printed is developed on one surface of the photosensitive belt 10 by a developing station 14, and the developed image is dried via a drying station 15 to then be transferred to a sheet of printing paper 1 by a transfer/pressing station 16 having a transfer roller 16*a* and a pressing roller 16*b*. The developing station 14 supplies a developer liquid to the photosensitive belt 10, and separates most of the liquid carrier contained in the developer liquid so that only toner is left over a latent electrostatic image portion of the photosensitive belt 10, thereby allowing transfer of the image in the transfer/pressing station 16.

The developing station 14, as shown in FIG. 3, is installed such that a development roller 21 and a development backup roller 22 selectively come in tight contact with the photosensitive belt 10 disposed therebetween. A developer liquid spray nozzle 23 is installed to spray a developer liquid between the development roller 21 and the photosensitive belt 10. The development roller 21 uniformly applies the developer liquid sprayed from the spray nozzle 23 to the photosensitive belt 10 while being rotated by a driving apparatus (not shown). A cleaning roller 24 is installed under the development roller 21 to be selectively in contact with the development roller, for cleaning the development roller 21. A squeezing roller 31 and a squeezing backup roller 32 are installed in the rear of the development roller 21 in view of the rotation direction of the development roller 21, so as to selectively come into tight contact with the photosensitive belt 10 disposed therebetween. By being passive-rotated in selective contact with the photosensitive belt 10, the squeezing roller 31 squeezes out the liquid carrier from the developer liquid applied on the photosensitive belt 10 for removal. Subsequently, the squeezing roller 31 reversely rotates in a drip line removal mode. Thus, although not shown, a separate driver for reversely rotating the squeezing roller 31 is provided in the developing station 14. A squeezing blade 34 contacts the squeezing roller 31 reversely rotating in the drip line removal mode, and removes the ink drawn by the squeezing roller 31. The squeezing blade 34 is configured to selectively contact the squeezing roller 31 and is spaced apart from the squeezing roller 31 in the printing mode, as shown in FIG. 3.

As shown in FIG. 4, the aforementioned developing station sequentially operates in the order of a printing mode (step S40), a development roller cleaning mode (step S50), a drip line removal mode (step S60) and a home mode (step S70), which will now be described in more detail.

Initially, in a printing standby state, the developing station is in a home mode (step S70). In the home mode (step S70), the development roller 21 and the squeezing roller 31 are spaced approximately 12 mm apart from the photosensitive belt 10. Here, the development roller 21 and the squeezing roller 31 do not rotate but are at a standstill.

In the home mode (step S70), if a printing start signal is applied, the development roller 21 and the squeezing roller 31 are pressed into tight contact with the photosensitive belt 10 by a pressing unit (not shown) with a predetermined pressure of about 20 kg/f. Here, the development roller 21 is rotated by a driver (not shown) and the squeezing roller 31 is passively rotated by the photosensitive belt 10. Then, a developer liquid is sprayed through the developer liquid spray nozzle 23, thereby performing the printing mode (step S40).

In the development roller cleaning mode (step S50), the development roller 21 is subjected to racing for the purposes of removing the developer liquid remaining on the developer liquid spray nozzle 23 and the cleaning roller 24 and sufficiently cleaning the development roller 21 after completing the printing mode (step S40). The development roller cleaning mode (step S50) is achieved by the racing of the development roller 21 in the same state as in the printing mode (step S40).

After completing the development roller cleaning mode (step S50), a drip line removal mode (step S60), in which unnecessary toner remaining on the photosensitive belt 10 is removed, is performed. In the drip line removal mode (step S60), the development roller 21 is spaced approximately 4 mm apart from the photosensitive belt 10. The squeezing roller 31 receives power from the not-shown driver in a state that it is pressed into tight contact with the photosensitive belt 10 with a predetermined pressure (about 4 kg/f), and rotates in the reverse direction to the printing mode, to collect the toner present on the photosensitive belt 10. Here, the squeezing blade 34 is brought into contact with the squeezing roller 31 which reversely rotates as above, and removes the toner collected by the squeezing roller 31.

After the drip line removal mode (step S60) is completed, the procedure is returned to the home mode (step S70) in which the development roller 21 and the squeezing roller 31 are spaced approximately 12 mm apart from the photosensitive belt 10 and is in a printing standby state.

However, according to the conventional method for controlling the mode of a developing station, a development roller cleaning mode is performed in a state that a development roller comes into tight contact with the photosensitive belt, after the printing mode and before the drip line removal mode. Thus, the photosensitive belt may be contaminated by the development roller while the development roller is being cleaned. Also, for the same reason as above, the development roller can be cleaned for only about 20 seconds. That is, a sufficient time for cleaning the development roller cannot be ensured. Accordingly, degradation in development quality cannot be avoided due to contamination of the development roller.

SUMMARY OF THE INVENTION

To solve the above problems, it is a first object of the present invention to provide a method for controlling the mode of a developing station of a liquid electrophotographic printer, which can prevent the photosensitive belt from being contaminated by a development roller in the development roller cleaning mode.

It is a second object of the present invention to provide a method for controlling the mode of a developing station of a liquid electrophotographic printer, which can ensure a sufficient time for cleaning the development roller.

It is a third object of the present invention to provide a development roller driving apparatus for implementing the method for controlling the mode of a developing station of a liquid electrophotographic printer.

Accordingly, to achieve the above objects, there is provided a method for controlling the mode of a developing station of a liquid electrophotographic printer, wherein a printing mode, a drip line removal mode and a home mode are sequentially performed, and a development roller is subjected to racing in the home mode to be cleaned.

Since the development roller is cleaned in the home mode in which the development roller is spaced approximately 12 mm apart from the photosensitive belt, the photosensitive belt is never contaminated by the development roller. Also, since cleaning of the development roller is performed after the drip line removal mode, a sufficient time for cleaning the development roller can be ensured.

According to another aspect of the present invention, there is provided a development roller driving apparatus for rotating a development roller which is positioned at different positions relative to a photosensitive belt according to a printing mode, a drip line removal mode, or the home mode. The apparatus includes a motor, which is a driving power source, a reduction gear train for reducing and transmitting power of the motor, a power relay gear installed to be engaged with the reduction gear train, and a link/gear assembly for transmitting the power relayed by the power relay gear to the development roller gear.

Here, the reduction gear train may include a first reduction gear having a large-diameter gear engaged with a pinion mounted on the motor shaft and a small-diameter gear coaxially installed with respect to the large-diameter gear of the first reduction gear, and a second reduction gear having a large-diameter gear engaged with the small-diameter gear of the first reduction gear and a small-diameter gear coaxially installed with respect to the large-diameter gear of the second reduction gear.

Also, the link/gear assembly may include a first gear installed to be engaged with the power relay gear, a link installed on a shaft of the first gear to be capable of swinging around the shaft and having a slot formed at one side into which the shaft of the second reduction gear is inserted, a second gear installed at one end of the link to be engaged with the first gear and the development roller gear, and an elastic supporting pin inserted into the shaft of the first gear, for elastically supporting the link counterclockwise to keep the second gear being engaged with the development roller gear.

In a preferred embodiment of the present invention, the development roller gear and the second gear engaged with the development roller gear have guiding surfaces provided at both ends of their teeth.

BRIEF DESCRIPTION OF THE DRAWINGS

The above objects and advantages of the present invention will become more apparent by describing in detail a preferred embodiment thereof with reference to the attached drawings in which.

DESCRIPTION OF THE PREFERRED EMBODIMENT

A preferred embodiment of the present invention will now be described in greater detail with reference to the accompanying drawings.

Figure 5:
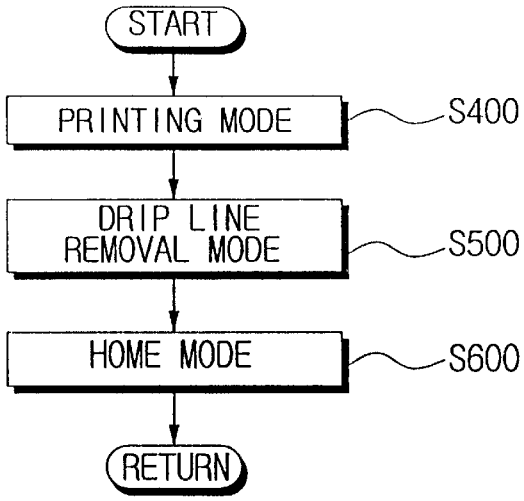
FIG. 5 is a flow chart illustrating a method for controlling the mode of a developing station according to the present invention.
Figure 6:
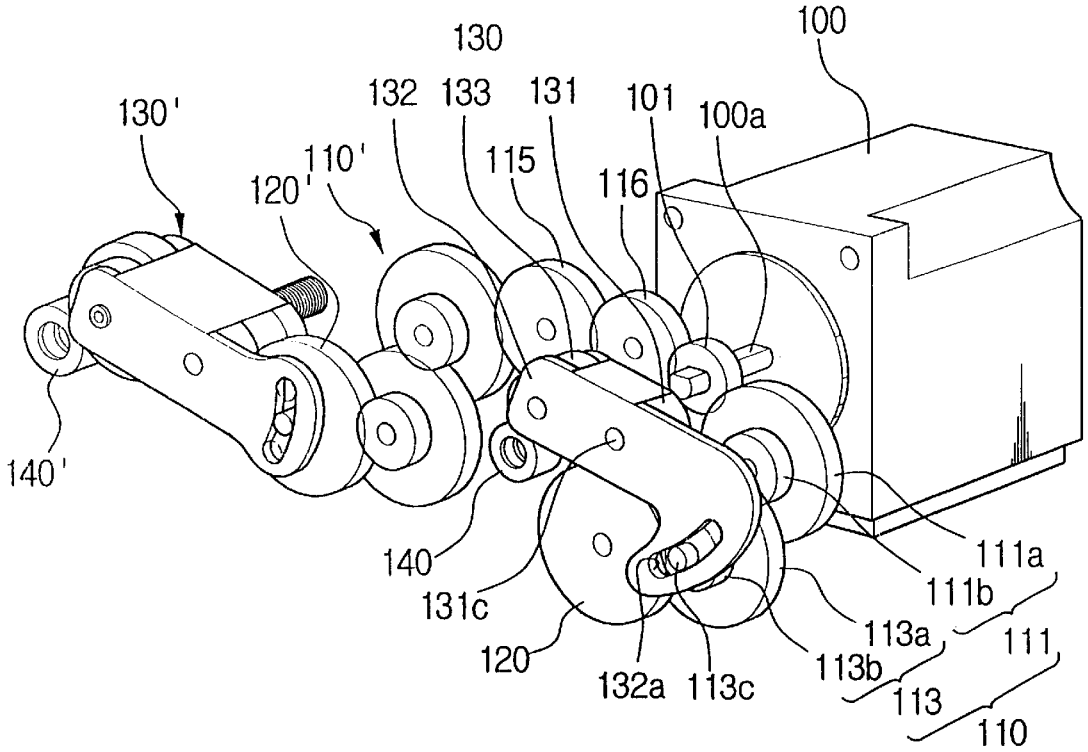
FIG. 6 is a perspective view of a development roller driving apparatus according to the present invention.

FIG. 5 is a flow chart illustrating a method for controlling the mode of a developing station according to the present invention, and FIGS. 6 through 10 illustrate a development roller driving apparatus for implementing the method for controlling the mode of a developing station according to the present invention.

As shown in FIG. 5, the method for controlling the mode of a developing station according to the present invention is sequentially performed in the order of a printing mode (step S400), a drip line removal mode (step S500) and a home mode (step S600), and the feature thereof lies in that racing of the development roller is performed in the home mode (step S600) for cleaning.

Figure 1:
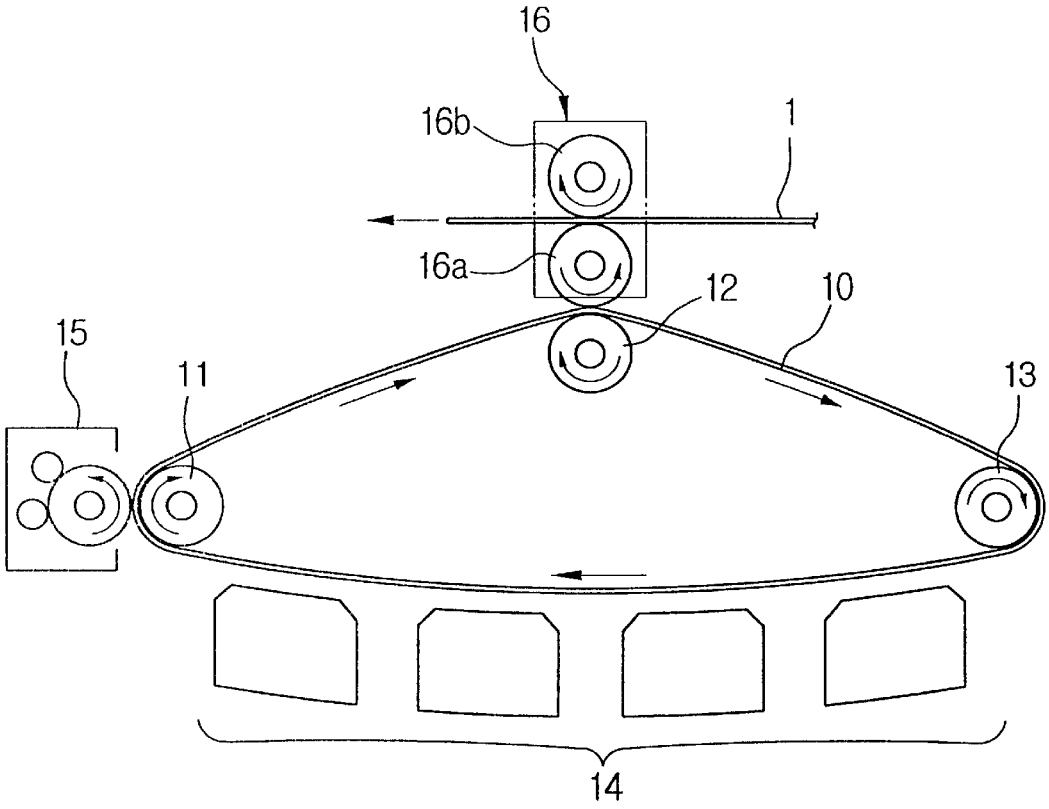
FIG. 1 (PRIOR ART)
FIG. 1 is a schematic diagram illustrating essential parts of a general liquid electrophotographic printer.
Figure 2:
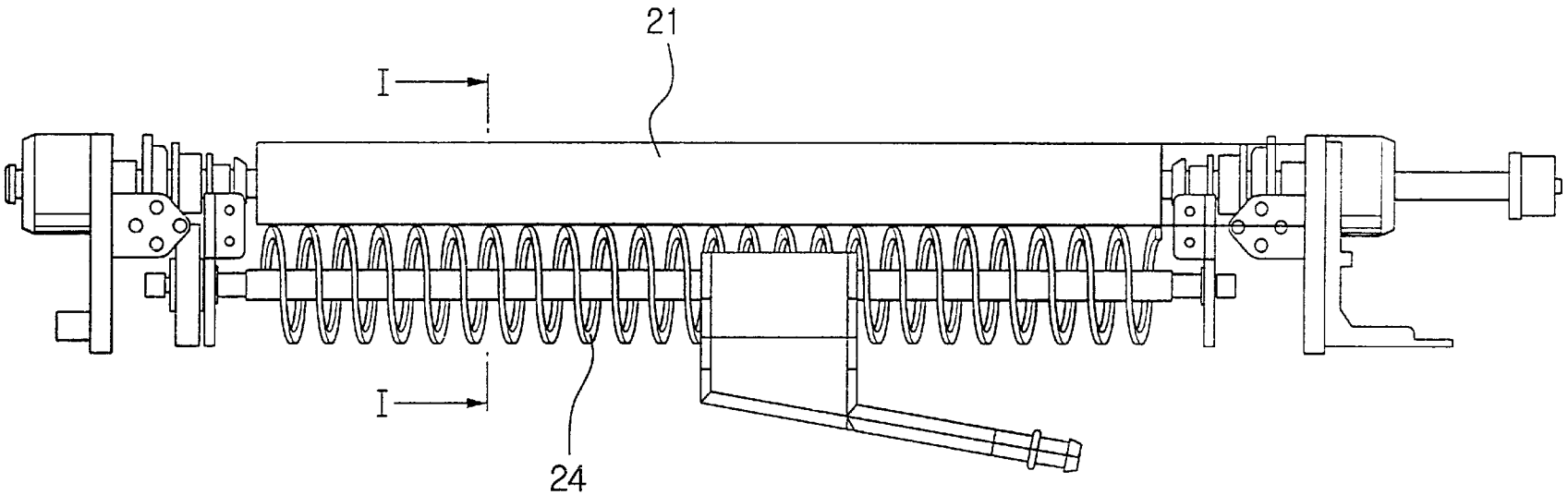
FIG.2 (PRIOR ART)
FIG. 2 is an exploded side view illustrating a developing station shown in FIG. 1.
Figure 3:
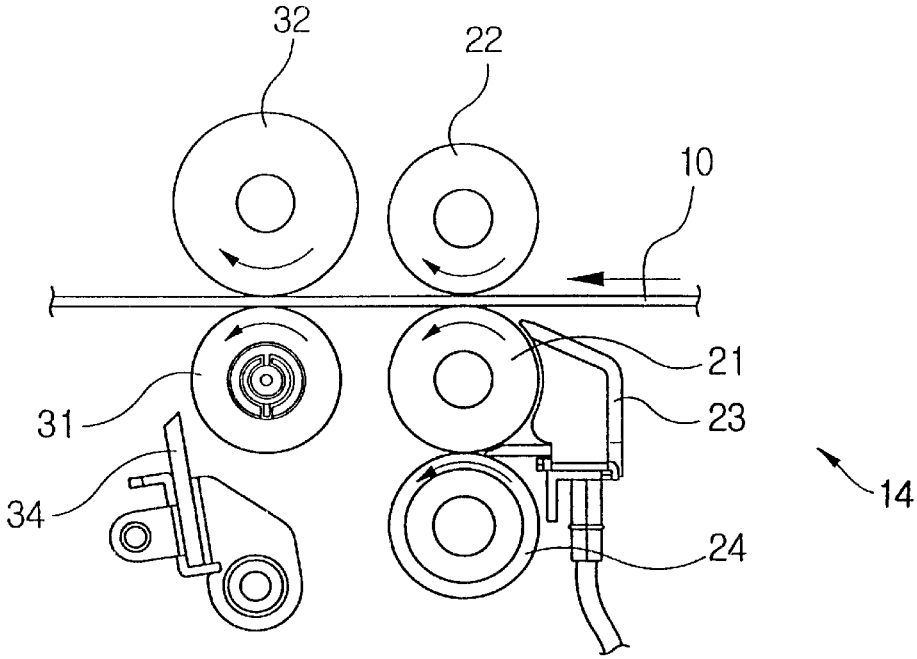
FIG.3 (PRIOR ART)
FIG. 3 is a cross-sectional view taken along the line I—I shown in FIG. 2.
Figure 4:
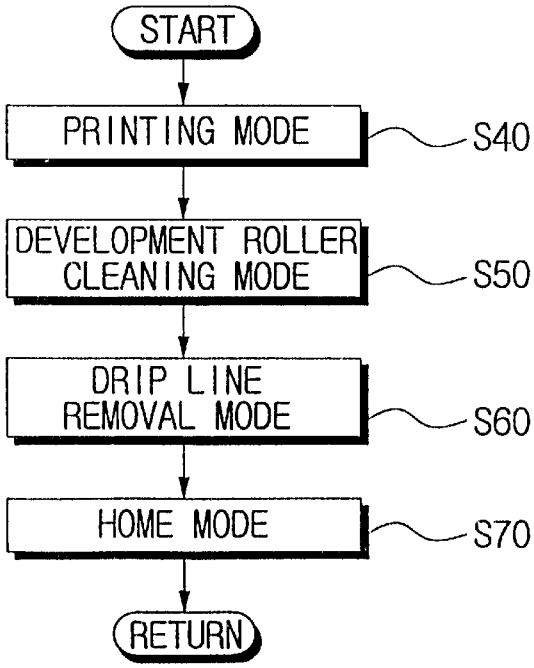
FIG.4 (PRIOR ART)
FIG. 4 is a flow chart illustrating a conventional method for controlling the mode of a developing station.

Unlike the prior art in which cleaning of the development roller (21 of FIG. 3) is performed immediately before the drip line removal mode in a state that the development roller 21 is in contact with the photosensitive belt 10, causing contamination of the photosensitive belt 10, in the present invention, cleaning of a development roller 21 is controlled to be performed in the home mode (step S600) in which the development roller 21 is sufficiently spaced apart from a photosensitive belt, approximately by 12 mm.

Thus, contamination of a photosensitive belt due to a development roller 21 can be prevented. Also, since the cleaning is performed in a home mode after a drip line removal mode, sufficient cleaning time can be ensured, thereby more delicate cleaning of the development roller 21 is achieved.

In order to implement the method for controlling the mode of a developing station according to the present invention, the development roller 21 must be rotated even when it is in the home mode. The structure of the development roller driving apparatus therefor and power transmission procedures in the respective modes are illustrated in FIGS. 6 through 9.

As shown in the drawings, the development roller driving apparatus of a liquid electrophotographic printer according to the present invention includes a motor 100 which is a driving power source, a reduction gear train 110 for reducing and transmitting power of the motor 100, a power relay gear 120 engaged with the reduction gear train 110, and a link/gear assembly 130 moving along with position-changing development roller 21 in respective modes for transmitting the power relayed by the power relay gear 120 to a development roller gear 140 for the color yellow.

A pinion 101 is mounted on a shaft 100*a* of the motor 100 and is engaged with the reduction gear train 110.

The reduction gear train 110 including a first reduction gear 111 and a second gear 113, is configured to reduce the power of the motor 100 in two phases. The first and second reduction gears 111 and 113 consist of large-diameter gears 111*a* and 113*a* and small-diameter gears 111*b* and 113*b*. The large-diameter gear 111*a* of the first reduction gear 111 is engaged with the pinion 101 mounted on the motor shaft 100*a*, and the small-diameter gear 111*b* is installed around the same shaft 111*c* (FIG. 7) of the large-diameter gear 111*a*. The large-diameter gear 113*a* of the second reduction gear 113 is engaged with the small-diameter gear 111*b* of the first reduction gear 111, and the small-diameter gear 113*b* is installed around the same shaft 113*c* of the large-diameter gear 113*a*.

The power relay gear 120 is configured to be engaged with the small-diameter gear 113*b* of the second reduction gear 113, and relays the power of the motor 100, which is reduced by the reduction gear train 110, to the link/gear assembly 130.

The link/gear assembly 130 includes a first gear 131 installed to be engaged with the power relay gear 120, a link 132 installed on a shaft 131*c* of the first gear 131 to be capable of swinging around the shaft 131*c*, a second gear 133 installed at one end of the link 132 to be engaged with the first gear 131 and the development roller gear 140, and an elastic supporting pin 134 (FIG. 7) inserted into the shaft 131*c* of the first gear 131, for elastically supporting the link 132 counterclockwise keeping the second gear 133 being engaged with the development roller gear 140. A slot 132*a* for allowing the link/gear assembly 130 to move to a position corresponding to the mode of the development roller 21, that is, a printing mode, a drip line removal mode and a home mode, is formed at the other end of the link 132. The shaft 113*c* of the second reduction gear 113 is inserted into the slot 132*a*.

Figure 10A:
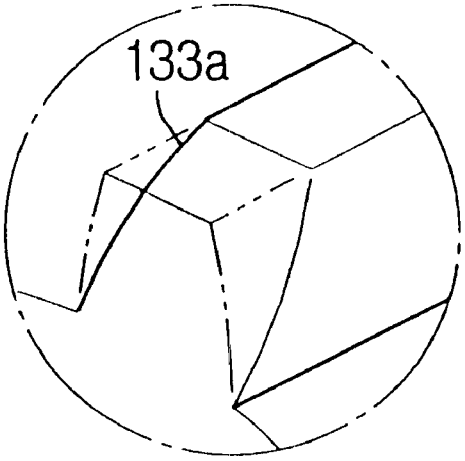
FIG. 10 is a diagram showing the structure of teeth of a development roller gear and a second gear of the development roller driving apparatus according to the present invention, and a tooth engagement thereof.
Figure 10B:
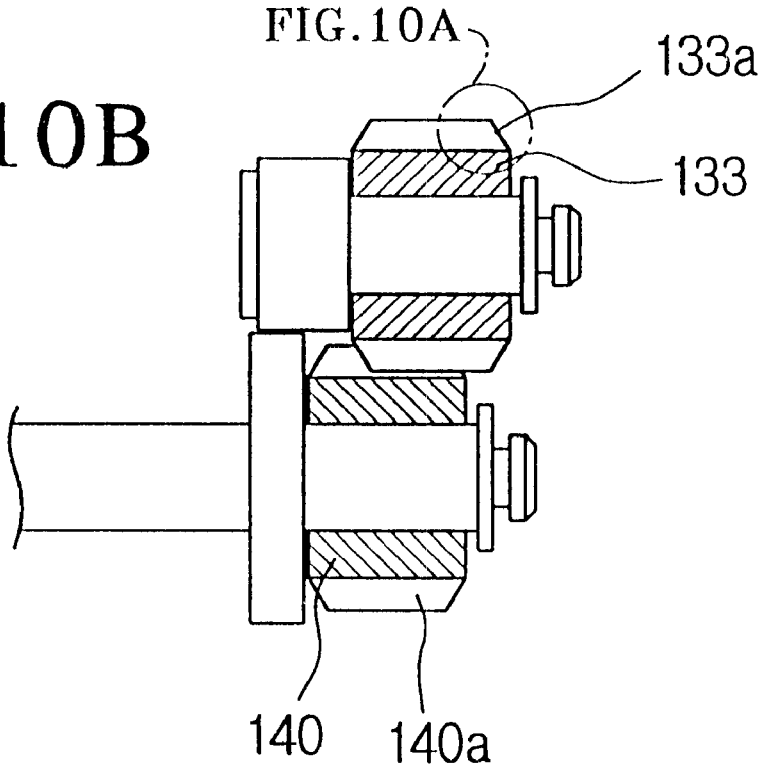

The development roller gear 140 and the second gear 133 of the ink/gear assembly 130 have guiding surfaces 140*a* and 133*a* formed at both ends of each gear tooth, respectively, as shown in FIG. 10. Both gears, that is, the development roller gear 140 and the second gear 133, can be smoothly assembled by the guiding surfaces 140*a* and 133*a*. That is, even if the teeth of both gears deviate from their proper assembly positions, the gears are properly placed by the guiding surfaces 140*a* and 133*a*, thereby being smoothly assembled.

In FIGS. 6 through 9, reference numeral 140' denotes a development roller gear for cyan, 130' a link/gear assembly for transmitting power to the development roller gear for cyan 140', 120' a power relay gear, and 110' a reduction gear train, respectively, which have the same structures as those of the above-described development roller gear 140 for yellow, and a detailed explanation thereof will not be given. Here, the reduction gear train 110' is connected to the pinion 101 mounted on the shaft 100*a* of the motor 100 by first and second idle gears 115 and 116 and receives power from the motor 100.

That is to say, the development roller driving apparatus according to the present invention is configured to simultaneously drive the development roller gear 140 for yellow (Y) and the development roller gear 140' for cyan (C). Also, although not shown, the development roller driving apparatus according to the present invention is configured to simultaneously drive a development roller gear for magenta (M) and a development roller gear for black (K).

The operation of the aforementioned development roller driving apparatus according to the present invention will now be described with reference to FIGS. 7 through 9. Since the power transmission procedures of four development rollers by mode are the same, only the yellow development roller driving mechanism will be representatively described.

Figure 7:
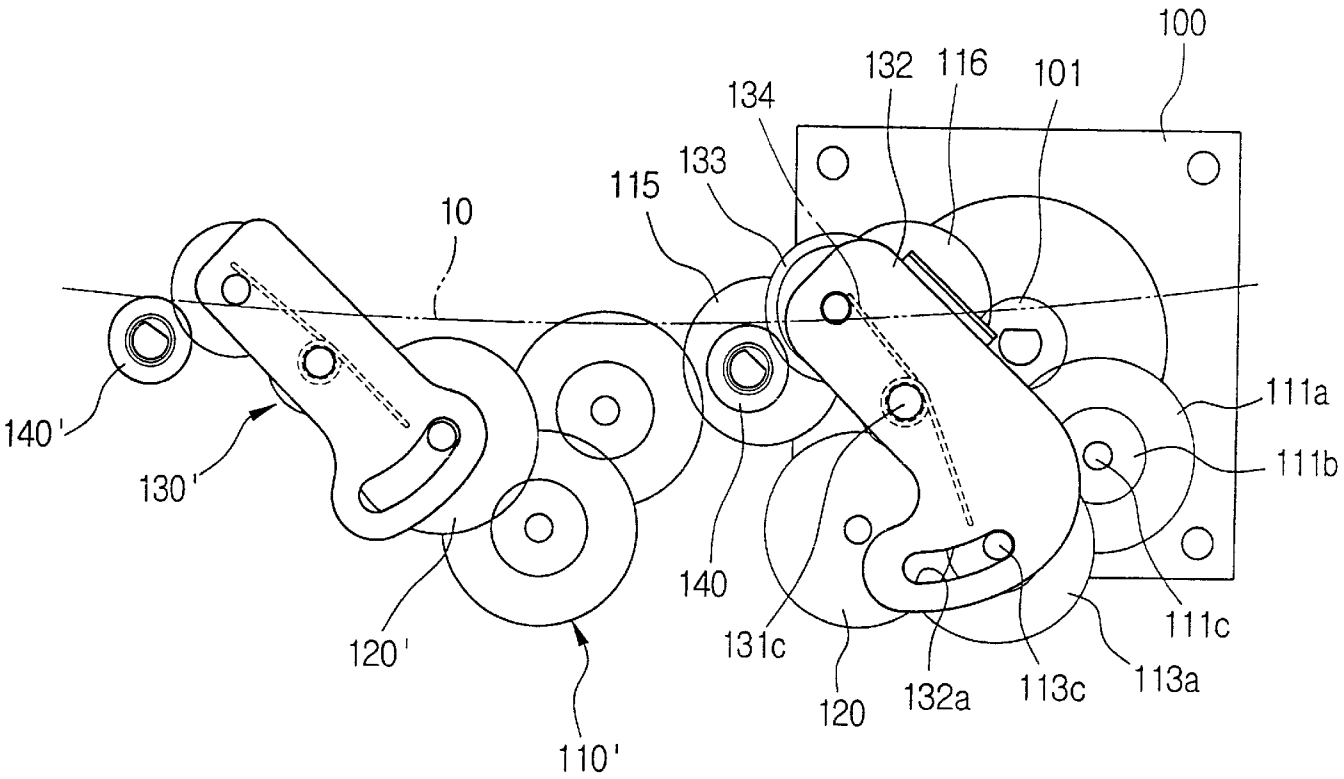
FIG. 7 shows a power transmission procedure in a printing mode of the development roller driving apparatus shown in FIG. 6.

In the printing mode, as shown in FIG. 7, a development roller, which is represented in FIG. 7 by a development roller gear 140 for brevity, and will be called as a development roller gear below, is raised by a pressing unit (not shown) into tight contact with the photosensitive belt 10. Here, the link/gear assembly 130 having the second gear 133 engaged with the development roller gear 140 is elastically supported by the elastic supporting pin 134 counterclockwise. Thus, in a state that the development roller gear 140 is engaged with the second gear 133, the link/gear assembly 130 rotates clockwise around the shaft 131*c* of the first gear 131 by the rising of the development roller gear 140. The link/gear assembly 130 finally stops at a position where the shaft 113*c* of the second reduction gear 113 contacts the end of the slot 132*a* of the link 132, while the power of the motor 100 is sequentially transmitted to the development roller gear 140 via the pinion 101, the first reduction gear 111, the second reduction gear 113, the power relay gear 120, the first gear 131 and the second gear 133.

Figure 8:
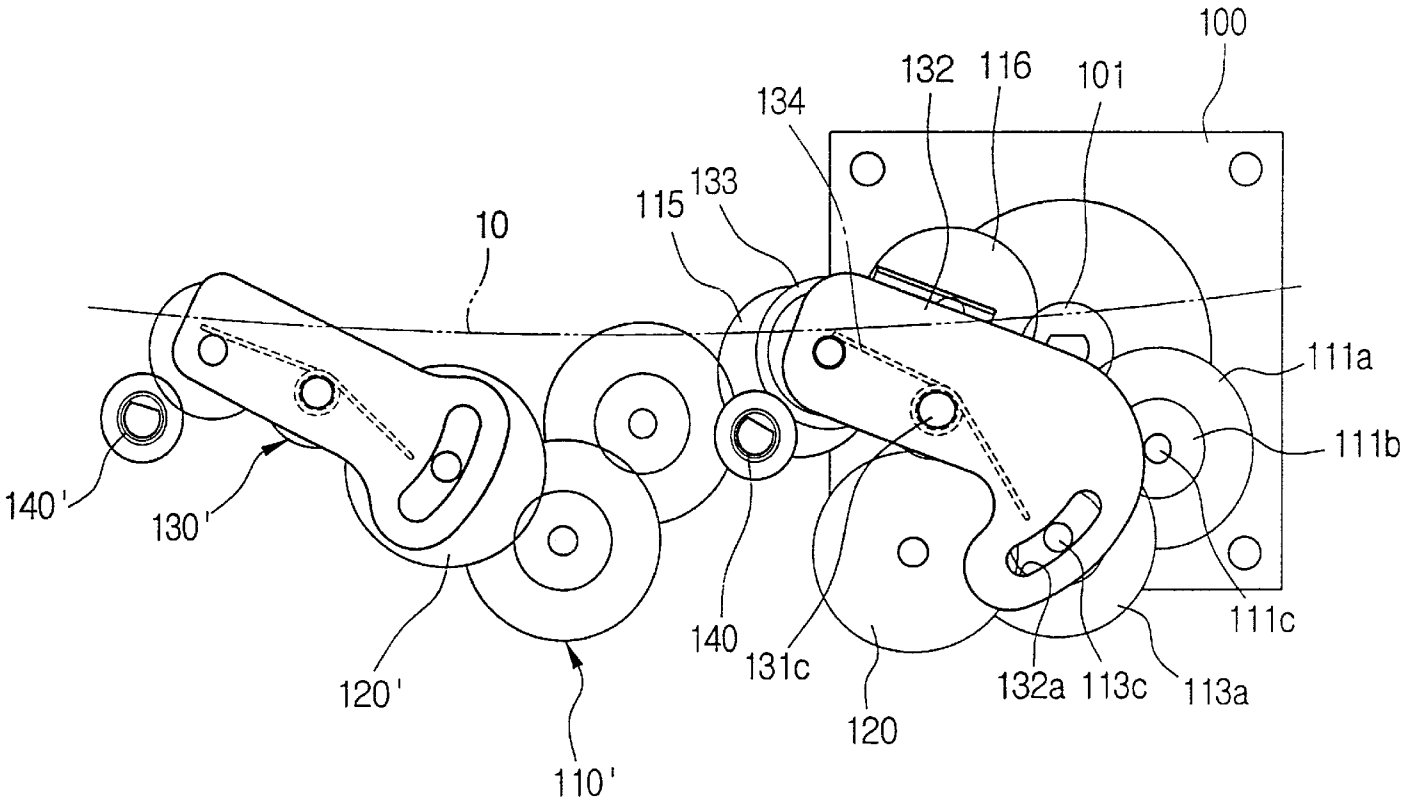
FIG. 8 shows a power transmission procedure in a drip line removal mode of the development roller driving apparatus shown in FIG. 6.

Next, in the drip line removal mode, as shown in FIG. 8, the development roller gear 140 is spaced at a predetermined distance from the photosensitive belt 10, that is, the development roller gear 140 is lowered by a pressing unit (not shown) to be spaced approximately 4 mm apart from the photosensitive belt 10. Here, since the link/gear assembly 130 is elastically supported by the elastic supporting pin 134 counterclockwise, it rotates counterclockwise around the shaft 113*c* of the second reduction gear 113 by the lowering of the development roller gear 140. Accordingly, the link/gear assembly 130 maintains the state as shown FIG. 8. In this state, since the second gear 133 of the link/gear assembly 130 and the development roller gear 140 are engaged with each other, the power of the motor 100 is transmitted to the development roller gear 140 in the above-described procedure.

Figure 9:
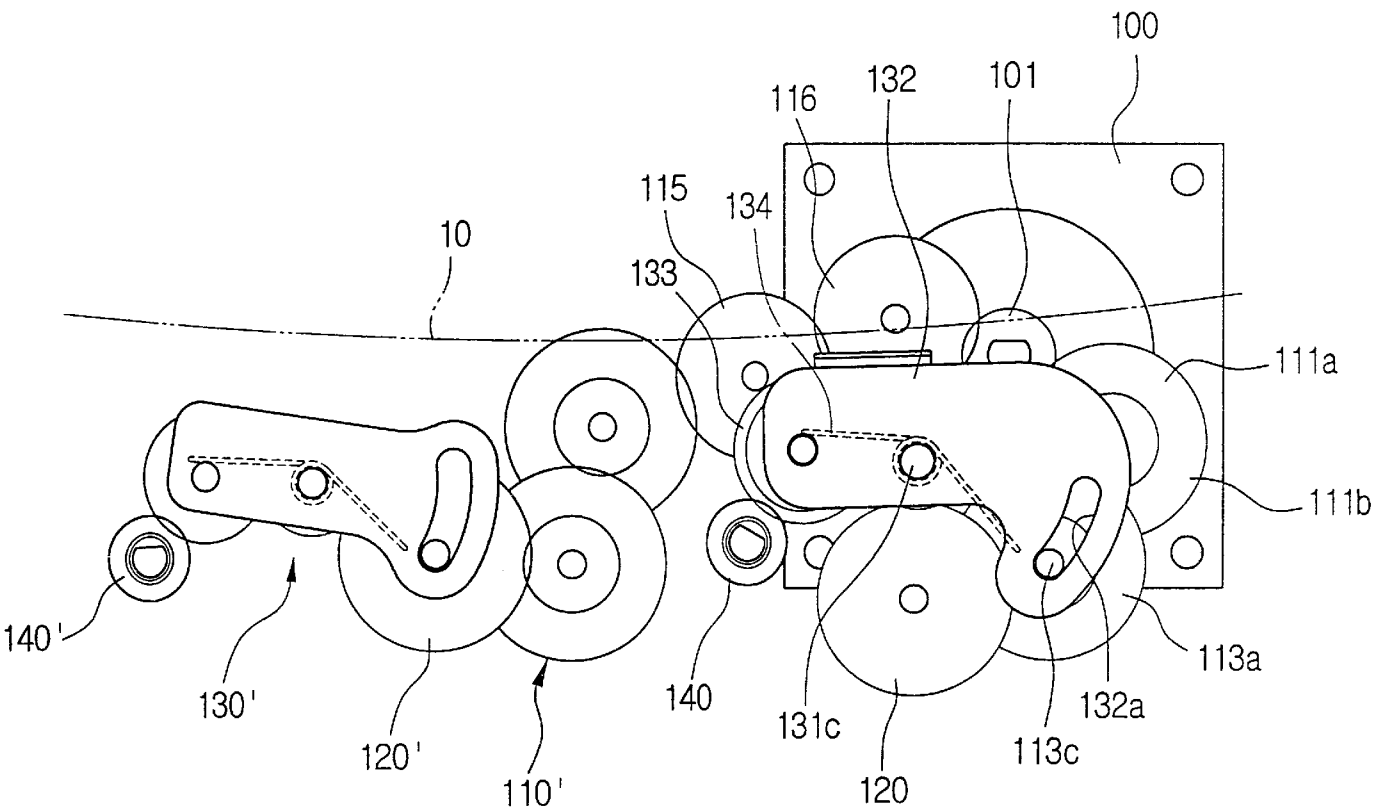
FIG. 9 shows a power transmission procedure in a development roller cleaning mode and a home mode of the development roller driving apparatus shown in FIG. 6.

In the home mode, as shown in FIG. 9, the development roller gear 140 is further lowered by the pressing unit until it is spaced approximately 12 mm apart from the photosensitive belt 10. The link/gear assembly 130 rotates counterclockwise by the elasticity of the elastic supporting pin 134, according to the lowering of the development roller gear 140. Accordingly, also in the home mode, the second gear 133 of the link/gear assembly 130 and the development roller gear 140 are engaged with each other, and the development roller 21 enters upon a rotatable state. Here, the development roller 21 can be cleaned while it is subjected to racing.

As described above, according to the present invention, since the cleaning of the development roller 21 is performed in the home mode in which the development roller 21 is spaced approximately 12 mm apart from a photosensitive belt, without a separate development roller cleaning mode like in the prior art, the photosensitive belt is not contaminated by the development roller 21 while cleaning the development roller 21. Thus, the service life of the photosensitive belt can be prolonged.

Also, according to the present invention, cleaning of the development roller 21 is performed after completing the drip line removal mode, a sufficient cleaning time can be obtained, which allows perfect cleaning of the development roller 21. Therefore, degradation in development quality due to contamination of the development roller 21 can be avoided.

Further, since the development roller 21 cleaning is performed in the home mode, that is, since a separate development roller cleaning mode is not necessary, the method for controlling the mode of a developing station can be simplified.

Although the invention has been illustrated and described with respect to exemplary embodiments thereof, the present invention should not be understood as limited to the specific embodiments set out above but various changes and modifications may be made by those skilled in the art, without departing from the spirit and scope of the present invention set out in the appended claims.

What is claimed is:

1. A method for controlling a mode of a developing station of a liquid electrophotographic printer, wherein a printing mode, a drip line removal mode and a home mode are sequentially performed, and a development roller is subjected to racing in the home mode in order to clean the development roller.

2. The method according to claim 1, wherein in the home mode, the development roller is spaced approximately 12 mm apart from a photosensitive belt.

3. A development roller driving apparatus for rotating a development roller which is positioned at different positions relative to a photosensitive belt according to a printing mode, a drip line removal mode or a home mode, the apparatus comprising:

a motor, having a motor shaft, and which is a driving power source;

a reduction gear train for reducing and transmitting power of the motor;

a power relay gear which engages with the reduction gear train and relays the power; and a link/gear assembly for transmitting the power relayed by the power relay gear to the development roller gear.

4. The development roller driving apparatus according to claim 3, wherein the reduction gear train comprises:

a first reduction gear having a first large-diameter gear engaged with a pinion mounted on the motor shaft and a first small-diameter gear coaxially installed with respect to the first large-diameter gear of the first reduction gear; and a second reduction gear having a second large-diameter gear engaged with the first small-diameter gear of the first reduction gear and a second small-diameter gear coaxially installed with respect to the second large-diameter gear of the second reduction gear.

5. The development roller driving apparatus according to claim 4, wherein the link/gear assembly comprises:

a first link/gear assembly gear engaged with the power relay gear;

a link installed on a link/gear assembly shaft of the first link/gear assembly gear to be capable of swinging around the first link/gear assembly shaft, and having a slot at a first side into which a second reduction gear shaft of the second reduction gear is inserted, wherein said slot is for allowing the link/gear assembly to move to a position corresponding to the printing mode, the drip line removal mode and, the home mode of the development roller;

a second link/gear assembly gear installed at an end of the link to be engaged with the first link/gear assembly gear and the development roller gear; and an elastic supporting pin inserted into the link/gear assembly shaft of the first link/gear assembly gear, for elastically supporting the link counterclockwise to keep the second link/gear assembly gear engaged with the development roller gear.

6. The development roller driving apparatus according to claim 5, wherein the development roller gear and the second link/gear assembly gear engaged with the development roller gear have guiding surfaces provided at both ends of teeth formed on the development roller gear and the second link/gear assembly gear.

* * * * *